US007695317B2

(12) United States Patent
Zhu et al.

(10) Patent No.: US 7,695,317 B2
(45) Date of Patent: Apr. 13, 2010

(54) ELECTRICAL CONNECTOR

(75) Inventors: Hong-Wei Zhu, Shenzhen (CN); Hai-Yang Yu, Shenzhen (CN); Er-Zheng Zhao, Shenzhen (CN); Hua Jiang, Shenzhen (CN); Gang-Hua Liu, Shenzhen (CN); Cheng-Tai Shih, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/264,263

(22) Filed: Nov. 4, 2008

(65) Prior Publication Data

US 2009/0311883 A1 Dec. 17, 2009

(30) Foreign Application Priority Data

Jun. 13, 2008 (CN) ..... 2008 1 0302125

(51) Int. Cl.
*H01R 13/648* (2006.01)

(52) U.S. Cl. ..... 439/607

(58) Field of Classification Search ..... 439/55, 439/607.27, 378, 660; 385/53; 361/803
See application file for complete search history.

(56) References Cited

U.S. PATENT DOCUMENTS

| | | | | |
|---|---|---|---|---|
| 3,492,538 | A * | 1/1970 | Fergusson | 361/803 |
| 5,125,849 | A * | 6/1992 | Briggs et al. | 439/378 |
| 6,705,899 | B1 * | 3/2004 | Ji | 439/660 |
| 6,832,856 | B2 * | 12/2004 | Chiu et al. | 385/53 |
| 7,074,082 | B2 * | 7/2006 | Kerlin et al. | 439/607.27 |

* cited by examiner

*Primary Examiner*—T C Patel
*Assistant Examiner*—Phuong Nguyen
(74) *Attorney, Agent, or Firm*—Frank R. Niranjan

(57) ABSTRACT

An electrical connector includes a printed circuit board, a plug fixedly and electrically connected to the printed circuit board, an electromagnetic shielding cover configured for encompassing the printed circuit board, a reinforced frame configured for framing the plug and the electromagnetic shielding cover to the circuit board and, a housing configured for housing the printed circuit board, the plug, the electromagnetic shielding cover and the reinforced frame therein.

11 Claims, 2 Drawing Sheets

ELECTRICAL CONNECTOR

TECHNICAL FIELD

The present disclosure generally relates to an electrical connector used for interconnecting an electrical device to another electrical device.

BACKGROUND

An electrical connector typically includes a housing, a plug, a printed circuit board, and an electromagnetic shielding cover. The printed circuit board is received in the housing. The plug is electrically mounted to the printed circuit board. The electromagnetic shielding cover wraps around the printed circuit board to provide electromagnetic protection for the printed circuit board. The plug has a holder and a number of pins fixed to the holder. When the electrical connector is plugged into a matching port of an electrical device or unplugged therefrom, the plugging/unplugging force also applies to the joint between the plug and the printed circuit board and tends to damage the electrical connection between the plug and the printed circuit board. The performance and stability of the electrical connector may be influenced thereby.

What is needed, therefore, is an electrical connector to overcome the above mentioned problems.

DETAILED DESCRIPTION OF THE EMBODIMENTS

Figure 1:
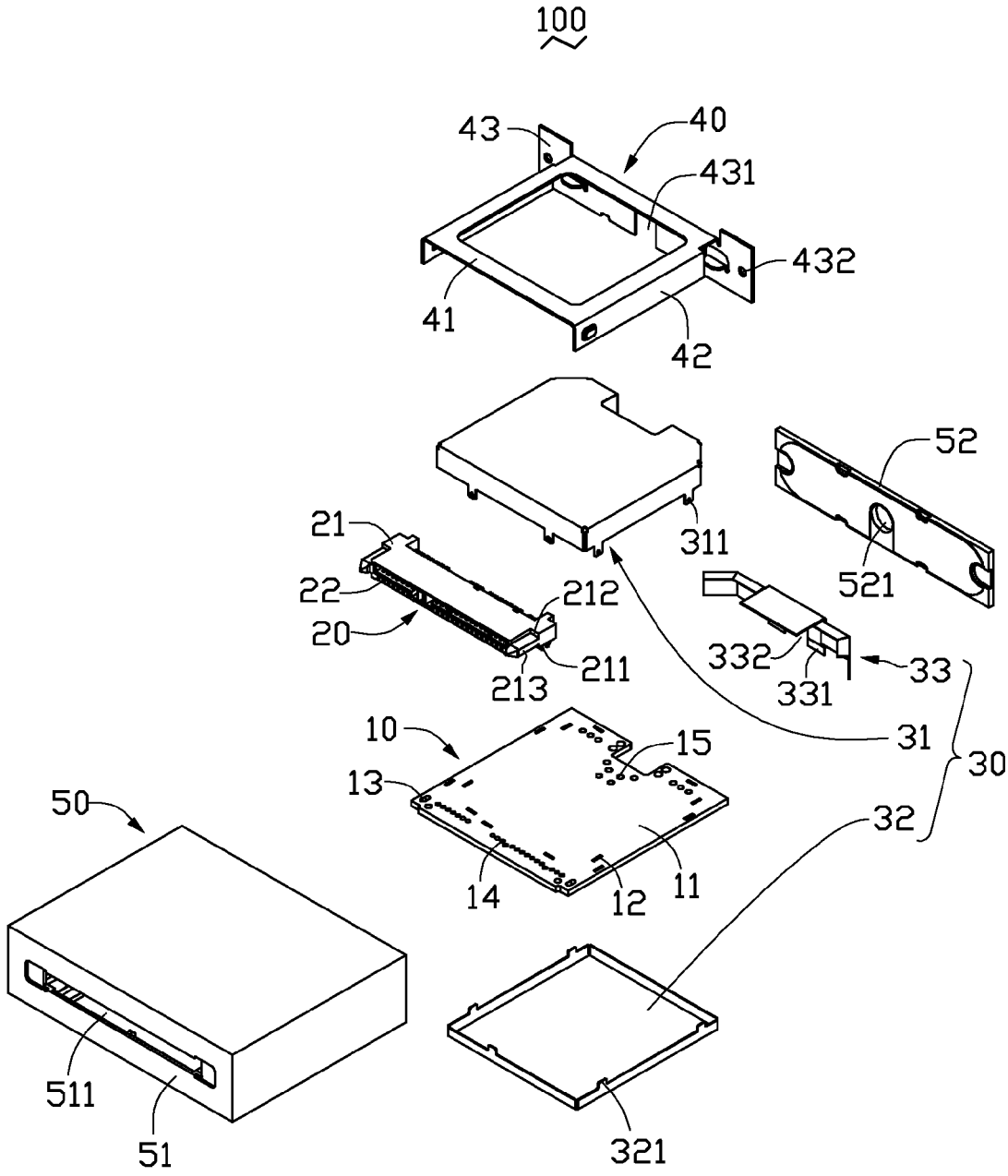
FIG. 1 is an isometric, exploded view of an electrical connector according to the invention.

Referring to FIG. 1, an electrical connector 100, according to an exemplary embodiment, is shown. The electrical connector 100 includes a printed circuit board 10, a plug 20 fixedly and electrically connected to the printed circuit board 10, a electromagnetic shielding cover 30 configured for covering the printed circuit board 10, a reinforced frame 40 configured for reinforcing the plug 20 and the electromagnetic shielding cover 30, a housing 50 configured for accommodating the printed circuit board, the plug, the electromagnetic shielding cover and the reinforced frame therein.

The printed circuit board 10 includes a substrate 11, and a series of first bonding pads 14 and second bonding pads 15 formed on the substrate 11. The first bonding pads 14 are electrically connected to the plug 20, and the second bonding pads 15 are connected to a cable (not shown) for information transmission. The substrate 11 defines a number of first through holes 12 and second through holes 13 for engagements of the electromagnetic shielding cover 30 and the plug 20.

The plug 20 includes a holder 21 and a series of pins 22 fixed in the holder 21. The holder 21 includes a series of second engaging feet 211 on the bottom surface thereof. The holder 21 also includes a surface 212 facing a port to be plugged into and two positioning pins 213 protruding away from the surface 212. The second engaging feet 211 are engaged into the corresponding second through holes 13 for fixedly mounting the plug 20 to the printed circuit board 10, and the pins 22 are electrically connected to the corresponding bonding pads 15 for electrically connecting the plug 20 with the printed circuit board 10. The positioning pins are 213 are configured for aligning and positioning the plug 20.

The electromagnetic shielding cover 30 includes a first electromagnetic shielding sub-cover 31, a second electromagnetic shielding sub-cover 32 and a third electromagnetic shielding sub-cover 33. The first, second and third electromagnetic shielding sub-cover 31, 32, 33 respectively includes a series of first engaging feet 311, 321 and 331. The first engaging feet 311, 321 and 331 are engaged in the corresponding first through holes 12 of the printed circuit board 10. The first and second electromagnetic shieding sub-cover 31, 32 covers the two surfaces of the first through holes 12 defined therethrough. The third electromagnetic shielding sub-cover 33 connects the first and second electromagnetic shielding sub-coverss 31, 32 and defines a first opening 332 as the cable entrance.

The reinforced frame 40 includes a panel 41, a pair of side plates 42 extending from two opposite edges of the panel 41, and a back plate 43 extending from another edge of the panel 41 substantially perpendicular to the side plates 42. The back plate 43 defines a second opening 431 aligned with the position of the first opening 332 of the third electromagnetic shielding sub-cover 33 to allow the cable to pass therethrough, and several screw holes 432 to allow a corresponding number of screws (not shown) to be inserted therethrough for fixing the reinforced frame 40 to the housing 50.

The housing 50 includes a hollow main body 51 and a back cover 52 attached to the main body 51 for enclosing the printed circuit board 10, the plug 20 and the electromagnetic shielding cover 30 in the main body 51 therein. The main body 51 defines a plug opening 511 to allow the plug 20 to protrude therethrough. The back cover 52 defines a third opening 521 aligned with the first opening 332 and the second opening 431 for the cable to pass through.

Figure 2:
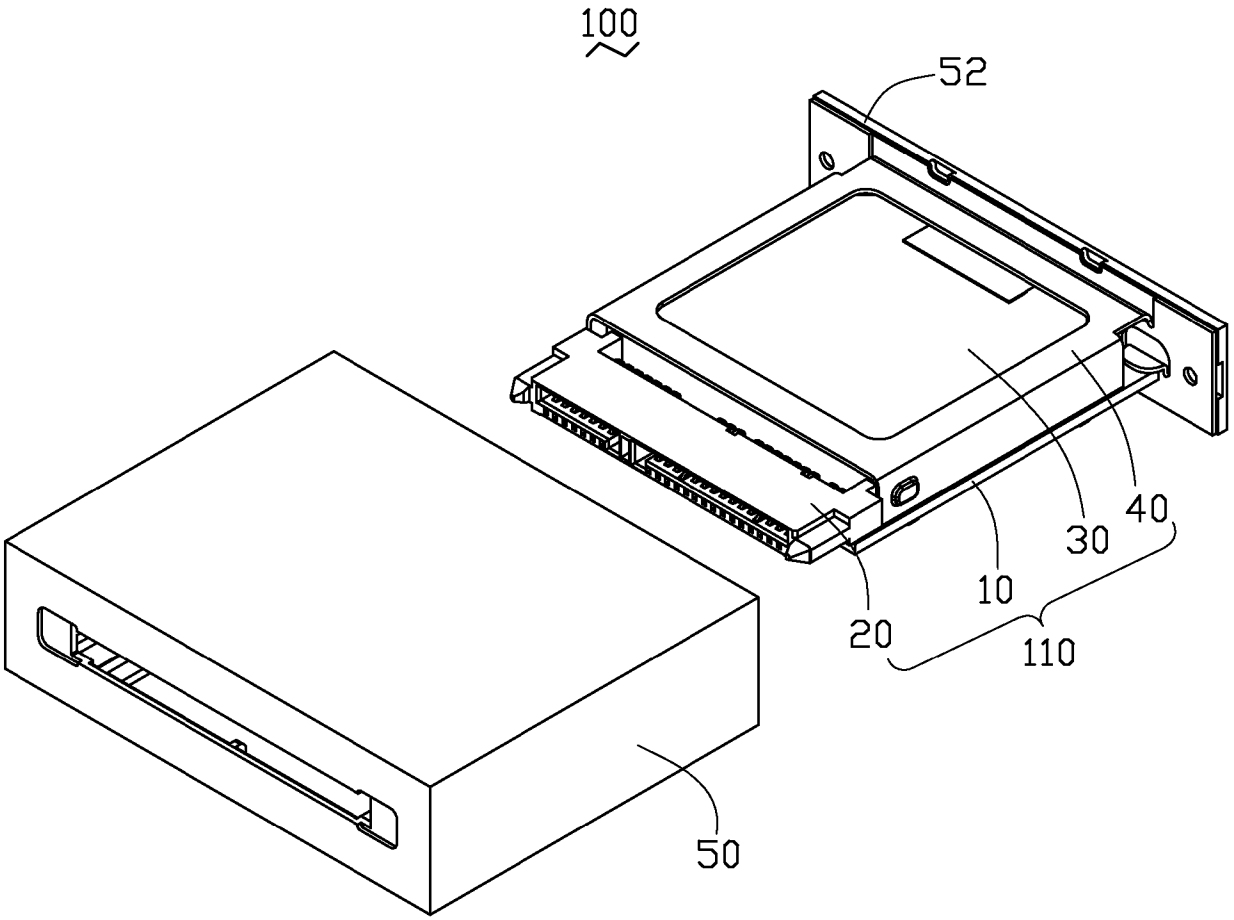
FIG. 2 is an isometric, semi-assembled view of the electrical connector of FIG. 1.

Referring to FIG. 2, the printed circuit board 10, the plug 20, the electromagnetic shielding cover 30 and the frame 40 are assembled together as a combination 110, wherein the fixture of plug 20 to the printed circuit board 10 is reinforced by the frame 40. The combination 100 is received in the housing 50. The plug 20 is partly inserted through the plug opening 511.

When the electrical connector 100 is plugged/unplugged into/from a matching port of an electrical device, the plugging/unplugging force applied to the plug 20 is shared by the reinforced frame 40 and also the housing 50 because the reinforced frame 40 is fixedly connected with the housing 50. Therefore, this electrical connector 100 can partially transfer the force applied to the plug 20 and thereby protect the electrical connection between the plug 20 and the printed circuit board 10 from being damaged. As a result, the performance and longevity of the plug 20 and the printed circuit board 10 are improved.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An electrical connector comprising:

a printed circuit board;

a plug fixedly and electrically connected to the printed circuit board;

a electromagnetic shielding cover configured for covering the printed circuit board;

a reinforced frame configured for reinforcing the plug and the electromagnetic shielding cover to the printed circuit board, comprising a first electromagnetic shielding sub-cover, a second electromagnetic shielding sub-cover and a third electromagnetic shielding sub-cover, the first electromagnetic shielding sub-cover, the second electromagnetic shielding sub-cover and the third electromagnetic shielding sub-cover being around the printed circuit board, the third electromagnetic shielding sub-cover defining a first opening as a cable entrance; and a housing configured for housing the printed circuit board, the plug, the electromagnetic shielding cover and the reinforced frame therein.

2. The electrical connector as claimed in claim 1, wherein the plug comprises a holder and a series of pins fixed in the holder.

3. The electrical connector as claimed in claim 2, wherein the holder comprises a surface facing a port to be plugged into and two positioning pins protruding away from the surface.

4. The electrical connector as claimed in claim 1, wherein the printed circuit board comprises a substrate, and a series of first bonding pads and second bonding pads formed on the substrate, the first bonding pads being electrically connected to the plug, and the second bonding pads being connected to a cable.

5. The electrical connector as claimed in claim 4, wherein the substrate defines a plurality of first through holes, the electromagnetic shielding cover comprising a plurality of first engaging feet and being fixedly mounted to the printed circuit board by engaging the first engaging feet into the first through hole.

6. The electrical connector as claimed in claim 5, wherein the substrate defining a plurality of second through holes, the plug coprising a plurality of second engaging feet and being fixedly mounted to the printed circuit board by engaging the second engaging feet into the second through holes.

7. The electrical connector as claimed in claim 1, wherein the frame comprises a panel, a pair of side plates extending from two opposite edges of the panel, and a back plate extending from another edge of the panel substantially perpendicular to the side plates.

8. The electrical connector as claimed in claim 7, wherein the back plate defines a second opening aligned with the first opening of the third electromagnetic shielding sub-cover, and several screw holes to allow a corresponding number of the screws therethrough for fixing the reinforced frame to the housing.

9. The electrical connector as claimed in claim 8, wherein the housing includes a hollow main body and a back cover attached to the main body for enclosing the printed circuit board, the plug and the electromagnetic shielding cover in the main body, the main body defines a plug opening to allow the plug protruding therethrough.

10. The electrical connector as claimed in claim 8, wherein the back cover defines a third opening aligned with the first opening and the second opening for passage of a cable.

11. The electrical connector comprising:

a printed circuit board;

a plug fixedly and electrically mounted to the printed circuit board; and a reinforced frame configured for reinforcing the plug to the printed circuit board, comprising a first electromagnetic shielding sub-cover, a second electromagnetic shielding sub-cover and a third electromagnetic shielding sub-cover, the first electromagnetic shielding sub-cover, the second electromagnetic shielding sub-cover and the third electromagnetic shielding sub-cover being around the printed circuit board, the third electromagnetic shielding sub-cover defining a first opening as a cable entrance.

* * * * *